US009758269B2

(12) United States Patent
Jäppi et al.

(10) Patent No.: US 9,758,269 B2
(45) Date of Patent: Sep. 12, 2017

(54) METHOD AND ARRANGEMENT FOR HANDLING NARROW ROLLS

(71) Applicant: UPM RAFLATAC OY, Tampere (FI)

(72) Inventors: Juha Jäppi, Tampere (FI); Ari Veikkola, Nokia (FI); Juho Kantanen, Vuorentausta (FI); Ari Hakala, Siuro (FI); Jukka Piitulainen, Siivikkala (FI)

(73) Assignee: UPM RAFLATAC OY, Tampere (FI)

( * ) Notice: Subject to any disclaimer, the term of this patent is extended or adjusted under 35 U.S.C. 154(b) by 0 days.

(21) Appl. No.: 14/403,096

(22) PCT Filed: May 21, 2013

(86) PCT No.: PCT/FI2013/050548
§ 371 (c)(1),
(2) Date: Nov. 21, 2014

(87) PCT Pub. No.: WO2013/175066
PCT Pub. Date: Nov. 28, 2013

(65) Prior Publication Data

US 2015/0118450 A1 Apr. 30, 2015

(30) Foreign Application Priority Data

May 22, 2012 (FI) ..... 20125543

(51) Int. Cl.
*B65C 3/06* (2006.01)
*B65H 19/30* (2006.01)
*B65C 9/46* (2006.01)

(52) U.S. Cl.
CPC ..... *B65C 3/06* (2013.01); *B65C 9/46* (2013.01); *B65H 19/30* (2013.01);
(Continued)

(58) Field of Classification Search
CPC ..... B65H 19/30; B65H 2301/4148; B65H 2301/41702; B65H 2301/41704;
(Continued)

(56) References Cited

U.S. PATENT DOCUMENTS 5,106,123 A * 4/1992 Shieh ..... B65H 18/28 206/390
2003/0025027 A1 2/2003 Ebisawa et al.
(Continued)

FOREIGN PATENT DOCUMENTS

EP 1 510 476 A1 3/2005
EP 2 368 802 A1 9/2011
(Continued)

*Primary Examiner* — Vishal I Patel
(74) *Attorney, Agent, or Firm* — Cantor Colburn LLP

(57) ABSTRACT

A product marking is disclosed in connection with a narrow roll. The narrow rolls are provided with a product marking in a first information adding step, the product marking including at least general information. In a second information adding step, the product marking in at least some of the narrow rolls is provided with customer information. After the second information adding step all the narrow rolls have a product marking comprising the customer information.

10 Claims, 4 Drawing Sheets

(52) U.S. Cl.
CPC ..... *B65H 2301/4148* (2013.01); *B65H 2301/41702* (2013.01); *B65H 2301/41704* (2013.01); *B65H 2301/5111* (2013.01); *B65H 2701/124* (2013.01); *B65H 2801/84* (2013.01); *Y10T 428/24802* (2015.01)

(58) Field of Classification Search
CPC ..... B65H 2701/124; B65H 2801/84; B65H 2301/5111; Y10T 428/24802; B65C 3/06; B65C 9/46
See application file for complete search history.

(56) References Cited

U.S. PATENT DOCUMENTS

| | | | | |
|---|---|---|---|---|
| 2004/0102870 | A1 | 5/2004 | Andersen et al. | |
| 2007/0022205 | A1 | 1/2007 | Kim | |
| 2007/0222205 | A1* | 9/2007 | Handa ..... | G09F 3/0288 283/81 |
| 2012/0037299 | A1* | 2/2012 | Baeta ..... | B31D 1/021 156/192 |

FOREIGN PATENT DOCUMENTS

| | | | |
|---|---|---|---|
| FI | 104483 | B | 2/2000 |
| WO | WO 99/44935 | A1 | 9/1999 |
| WO | WO 2008/010239 | A1 | 1/2008 |

* cited by examiner

METHOD AND ARRANGEMENT FOR HANDLING NARROW ROLLS

FIELD OF THE INVENTION

The invention relates to a method and arrangement for handling narrow rolls.

A method and an apparatus for the handling of loads is described in EP 1510476.

BRIEF DESCRIPTION OF THE INVENTION

An object of the invention is to provide a new type of method and arrangement.

The invention is characterized by the features of the independent claims.

According to an embodiment narrow rolls are formed from a jumbo reel. At least two slitting machines are used for forming the narrow rolls. The jumbo reel has an axial direction when positioned on the slitting machine. The narrow rolls are transferred to the warehouse in the axial direction. The at least two slitting machines are positioned overlapping.

According to another embodiment narrow rolls are provided with a product marking in a first information adding step, the product marking comprising at least general information. In a second information adding step, the product marking in at least some of the narrow rolls is provided with customer information. After the second information adding step all the narrow rolls have a product marking comprising the customer information.

BRIEF DESCRIPTION OF THE DRAWINGS

In the following the invention will be described in greater detail by means of preferred embodiments with reference to the accompanying drawings, in which.

In the figures the embodiments are presented in a simplified manner for the sake of clarity. In the figures like parts are designated by like reference numerals.

DETAILED DESCRIPTION OF THE EMBODIMENTS

Figure 1:
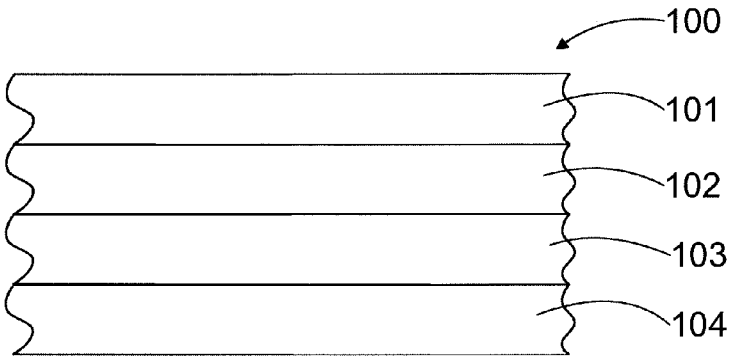
FIG. 1 is a schematic side view of a self adhesive laminate.

In this description the term narrow roll means a roll or a coil that is slitted from a jumbo reel. Slitting of the jumbo reel may be performed by using a slitting machine or a slitter-winder. Thus, the width of the narrow roll is smaller than the width of the jumbo reel. In an embodiment the narrow roll is cut to the length and/or width specified by a customer. In an embodiment the width of the narrow roll is smaller than 2000 mm and in another embodiment the width of the narrow roll is smaller than 1250 mm. In a further embodiment the width of the narrow roll is larger than 50 mm and in a further embodiment the width of the narrow roll is larger than 100 mm. In another embodiment the width of the narrow roll is between 50 and 2000 mm and in another embodiment the width of the narrow roll is between 100 and 1250 mm. In one embodiment the diameter of the narrow roll is smaller than 1300 mm and in another embodiment the diameter of the narrow roll is smaller than 1250 mm. In a further embodiment the diameter of the narrow roll is larger than 200 mm and in another embodiment the diameter of the narrow roll is larger than 300 mm. In a further embodiment the diameter of the narrow roll is between 200 and 1300 mm and in another embodiment the diameter of the narrow roll is between 300 and 1250 mm. In one embodiment the weight of the narrow roll is smaller than 2000 kg and in another embodiment the weight the narrow roll is smaller than 1250 kg. In another embodiment the weight of the narrow roll is more than 5 kg and in another embodiment the weight of the narrow roll is more than 10 kg. In one embodiment the weight of the narrow roll is between 5 kg and 2000 kg and in another embodiment the weight of narrow roll is between 10 and 1250 kg. In one embodiment the narrow roll is a self adhesive laminate roll wherein the adhesive is a pressure sensitive adhesive.

FIG. 1 shows a self adhesive laminate 100. In the embodiment the self adhesive laminate 100 comprises a face 101, an adhesive 102, a release component 103 and a release liner 104. The face 101 may be a face paper, for example. The adhesive 102 may be a pressure sensitive adhesive wherein the adhesive is in an activated mode, for example. The release component 103 or release material may be a silicon layer, for example. The release liner 104 may be release paper, for example. The face 101, the adhesive 102, the release component 103 and the release liner 104 may all have a one layer structure or a multilayer structure. In another embodiment the self adhesive laminate 100 comprises only the face 101 and the adhesive 102.

The self adhesive laminate is typically wound on a narrow roll during storage and transportation. The self adhesive laminate and the self adhesive laminate rolls are vulnerable to damages during their handling. Typically also the self adhesive laminate rolls in a warehouse have different widths and lengths and/or diameters. It is also typical that one delivery to the customer comprises self adhesive laminate rolls having different widths and/or diameters. The widths and/or diameters of the self adhesive laminate rolls can vary also within one customer stack that is typically positioned on a pallet. The different widths and/or diameters of the self adhesive laminate rolls provide further challenges for the handling of the self adhesive laminate rolls. Thus, the material of the narrow roll may be self adhesive laminate. Other materials of the narrow roll may be shrink film or paper, for example. In an embodiment the grammage of the material is less than 500 g/m$^2$ and in another embodiment the grammage of the material is less than 300 g/m$^2$. In a further embodiment the grammage of the material is more than 20 g/m$^2$ and in another embodiment the grammage of the material is more than 50 g/m$^2$. In a further embodiment the grammage of the material is between 20 and 500 g/m$^2$ and in another embodiment the grammage of the material is between 50 and 300 g/m$^2$.

Figure 3:
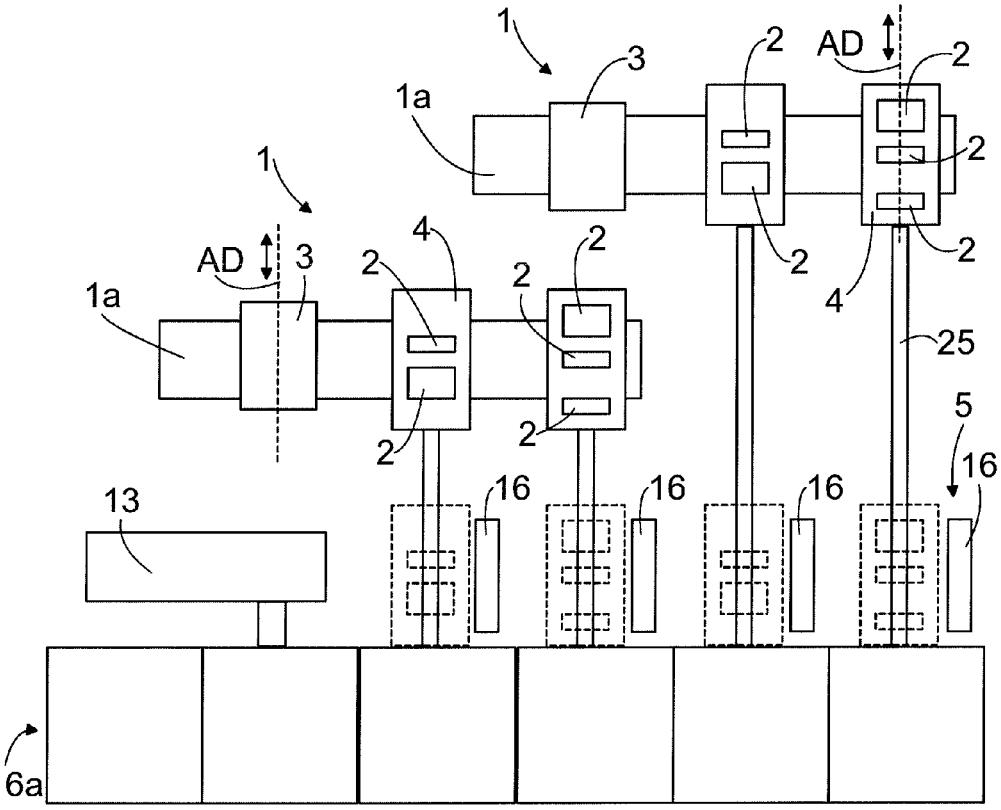
FIG. 3 is an enlarged layout of the inlet end of the warehouse shown in FIG. 2.
Figure 2:
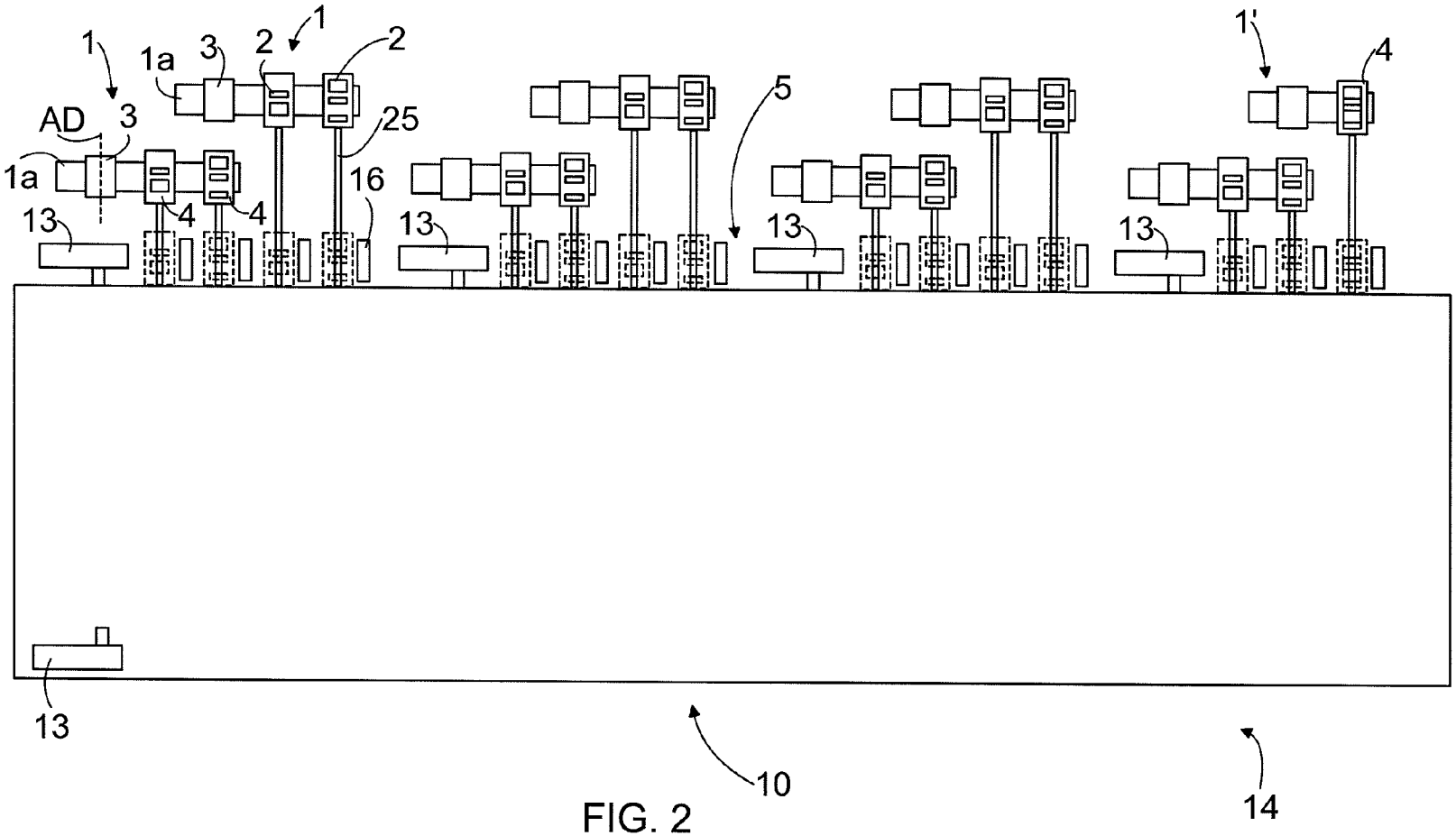
FIG. 2 is a schematic layout of a warehouse.

FIGS. 2 and 3 show a slitting machine 1 that forms self adhesive laminate rolls 2 from a jumbo reel 3. The jumbo reel 3 has an axial direction that is denoted with a broken line having a reference marking AD. Naturally the formed narrow rolls 2 have the same axial direction AD. The axial direction of the jumbo reel and the narrow roll is the direction of the center of the circular form. Thus, seen from the axial direction the jumbo reel and the narrow rolls have a circular form.

The narrow rolls 2 are formed on carrier tables 4.

The carrier tables 4 feed the narrow rolls 2 into the inlet end 5 of the flow-through warehouse 14. More precisely the narrow rolls are carried by the carrier table 4 from the slitting machine 1 close to the first rack row 6*a* and fed into the first rack row 6*a*.

The carrier table 4 carries the narrow rolls in a first direction and feeds them into the rack also in the first direction. In one embodiment the first direction is the same as the axial direction. In that embodiment turning of the carrier table is avoided. In an embodiment turning of the narrow rolls is avoided or the direction of axis of the narrow rolls is maintained unamended or stable. In one embodiment, maintaining the direction of axis unamended or stable or avoiding turning of the narrow rolls means that a movement around a direction that is different than the axial direction is less than 10° and in another embodiment less than 5°.

In the flow-through warehouse 14 a customer stack is formed of several narrow rolls 2 and the customers stack is delivered from the outlet end 10 of the warehouse. A customer stack may comprise narrow rolls 2 that have different widths and diameters and/or lengths. In such case, typically, the customer stack is formed such that at least mainly the narrow rolls having the largest diameters are positioned lowest in the customer stack. A finished customer stack means that the number and type, i.e. width and length, of the narrow rolls is correct and that the order of the narrow rolls 2 is correct. By avoiding turning of the narrow rolls it is secured that the unwinding direction of the narrow rolls is the same when they come out of the warehouse.

Typically the customer stack is eventually provided on a pallet. On the pallet the customer stack typically lies such that the narrow roll 2 having the largest diameter is the lowest. Depending on the size of the pallet and the sizes of the customer stacks the pallet may comprise one or more customer stacks.

There are a plurality of rewinders 13 at the inlet end 5 of the warehouse. Rewinding is needed if a narrow roll that has a length/diameter that is smaller than that of the jumbo reel 3 is needed. Rewinding is also used for forming larger/longer narrow rolls. In that case two narrow rolls may be combined, for example. During rewinding also resizing may be performed. In that case a narrow part from the edge of the material in the narrow roll may be slitted. Rewinding is also needed if a narrow roll is too loose.

Because rewinding is needed quite often in one embodiment there is one rewinder 13 per five slitting machines 1. In another embodiment there is one rewinder 13 per three slitting machines 1. In the embodiment in FIG. 1 there is one rewinder 1 per two slitting machines 1. At the outlet end 10 there is still another rewinder 13 if rewinding is needed at the outlet end 10.

Figure 4:
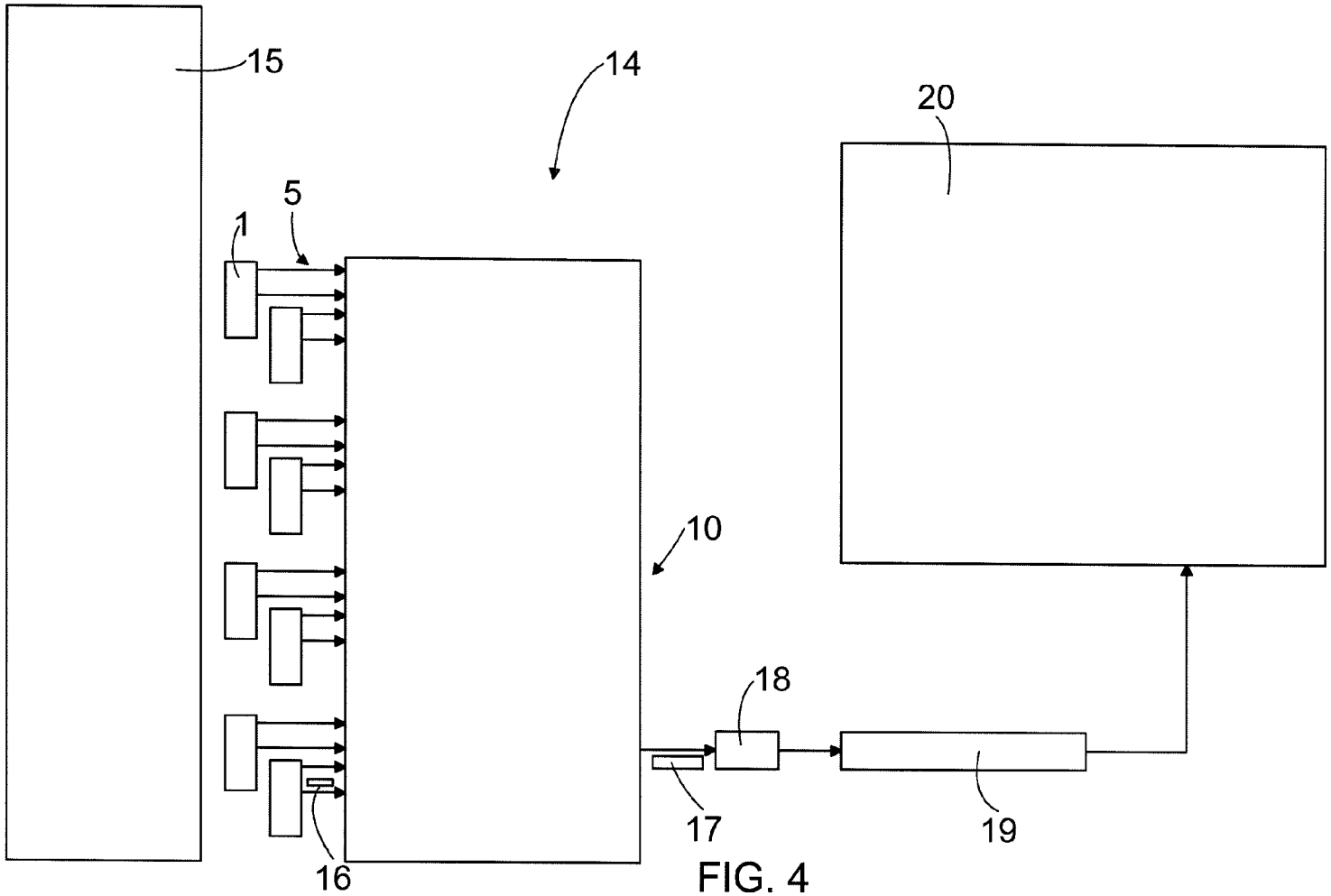
FIG. 4 is a schematic layout of another warehouse and FIGS. 5 and 6 are examples of product marking.

In an embodiment shown in FIGS. 2, 3 and 4 the slitting machines 1 are positioned overlapping. This means that seen from the inlet end 5 in the axial direction AD the body 1*a* of one slitting machine 1 is behind a body 1*a* of another slitting machine 1. This overlapping provides the feature that the slitting machines 1 do not need a wide space in the transverse direction and thus, the size of the warehouse building can be kept reasonable.

The jumbo reel 3 is positioned on the body 1*a* of the slitting machine such that it has the axial direction AD. The axial direction of the jumbo reel is maintained during the slitting process and the formed narrow rolls 2 also have the same axial direction AD. The narrow rolls 2 are transferred in the axial direction AD to the first row 6*a* of the flow-through warehouse 14. In the embodiment shown in FIGS. 2, 3 and 4 only two slitting machines 1 are positioned overlapping each other. It is also possible to provide more than two slitting machines 1 overlapping each other. In such a case however the transfer line from at least one slitting machine to the first rack row 6*a* becomes rather long.

The carrier tables 4 have a direct line in the axial direction AD from the slitting machine 1 to the first rack row 6*a* such that they have a short transfer line 25 and because the axial direction of the narrow rolls 2 is maintained the tables need not be turned.

Two slitting machines 1 can be partially overlapping or totally overlapping. The two slitting machines 1 may be similar but they may also be different, for example such that the length of the body 1*a* of one slitting machine 1 differs from that of another slitting machine 1. Thus, in this connection total overlapping of the slitting machines 1 means that seen from the inlet end 5 in the axial direction AD the body 1*a* of the slitting machine 1 that is farther away from the inlet end 5 is in its entirety behind the body 1*a* of the slitting machine 1 closer to the inlet end 5. Correspondingly partial overlapping of the slitting machines 1 means that seen from the inlet end 5 in the axial direction AD a part of the body 1*a* of the slitting machine 1 farther away from the inlet end 5 can be seen from behind the body 1*a* of the slitting machine 1 closer to the inlet end 5.

If the slitting machines 1 are totally overlapping the transfer line 25 from the slitting machine 1 farther from the inlet end 5 is arranged to go through the slitting machine 1 that is closer to the inlet end 5. If partial overlapping is used the transfer line 25 of the slitting machine 1 farther away from the inlet end 5 need not go through the other slitting machine. Partial overlapping is illustrated in FIGS. 2, 3 and 4.

In one embodiment the body 1*a* of one slitting machine 1 overlaps with another body 1*a* of the other slitting machine 1 by 10-70%. This overlapping percentages tells how much the body of the slitting machine 1 farther way from the inlet end 5 is behind the body 1*a* of the slitting machine 1 closer to the inlet end 5 seen the axial direction AD. Thus, if the slitting machines 1 overlap by 30%, for example, 30% of the body 1*a* of the slitting machine 1 farther away from the inlet end 5 is behind the body 1*a* of the slitting machine 1 closer to the inlet end 5.

The dimensions of the slitting machines 1 may be different. For example, the length of a slitting machine forming the narrow rolls on only one carrier table 4, as shown with reference numeral 1' in FIG. 2, is typically shorter than that of a slitting machine 1 that forms the narrow rolls on two carrier tables 4. The width of a slitting machine may in one embodiment vary between 2, 5 and 15 m and in another embodiment between 3 and 10 m. The length of the slitting machine may in one embodiment vary between 3 and 20 m and in another embodiment between 4 and 15 m. The width of the slitting machine is the dimension in the axial direction and the length of the slitting machine is the dimension in a direction transverse to the axial direction.

The rewinder 13 may also overlap one of the slitting machines 1. By positioning a rewinder 13 between the body 1*a* of the slitting machine and the first rack row 6*a* the space in the warehouse can be used optimally.

The rewinder 13 and the slitting machine 1 may be partly overlapping or totally overlapping. Typically the body of the rewinder 13 is smaller than the body 1*a* of the slitting machine 1. Thus, in this connection total overlapping of the rewinder 13 and the slitting machine 1 means that seen from the inlet end 5 in the axial direction AD the rewinder 13 is in its entirety between the body 1*a* of the slitting machine 1 and the first row 6*a* of the warehouse. Correspondingly partial overlapping of the rewinder 13 and the slitting machine 1 means that seen from the inlet end 5 in the axial direction AD only a part of the rewinder 13 is between the body 1*a* of the slitting machine 1 and the first rack row 6*a* of the warehouse.

The rewinder 13 may be positioned partly or totally inside the first rack row 6*a*. Naturally in such case the storing surface or channel of the rack where the rewinder 13 is positioned is shorter than the storing surface or channel of other racks.

The dimensions of the rewinders may vary for example such that in one embodiment the width of the rewinder is between 1 and 3 m and the length of the rewinder is between 2 and 5 m.

FIG. 4 shows a schematic layout of the warehouse. FIG. 4 shows a jumbo reel warehouse 15 wherefrom the jumbo reels 3 are transferred to the slitting machines 1. After the slitting machines but before the first rack row 6*a* there are first information adding units 16. For the sake of the clarity only one information adding unit 16 is shown in FIG. 4. However FIGS. 2 and 3 show these first information adding units 16.

After the flow-through warehouse 14, at the outlet end 10, there is a second information adding unit 17.

After the outlet end 10 there is also an interleave unit 18. In the interleave unit 18 an interleaving paper is positioned between the narrow rolls 2 in a customer stack.

From the interleave unit 18 the customer stacks are transferred to a packaging line 19. The interleave unit 18 may also be situated in the packaging line 19. In the packaging line 19 the customer stacks are positioned on a pallet and the stack and the pallet are bound and wrapped for transportation. From the packaging line 19 the pallets with the customer stacks are transferred to a pallet warehouse 20. From the pallet warehouse 20 the pallets with the stacks are transported to the customer by trailer lorries or trailer trucks, for example.

Figure 5:
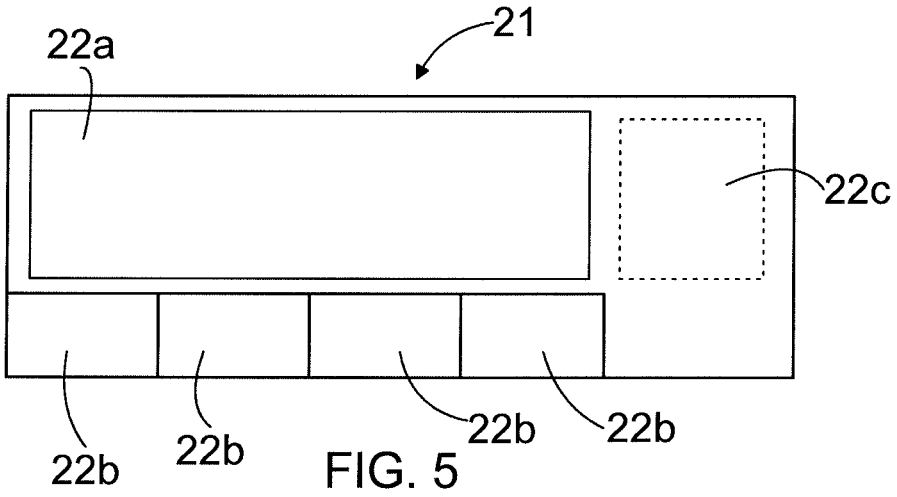

By the first information adding unit 16 each narrow roll 2 is provided with a product marking 21. FIG. 5 shows an example of a product marking 21. The product marking 21 may comprise general information 22*a*. General information 22 may comprise information relating to the narrow roll and the product in the narrow roll. Thus the information may comprise information of the material such as the material of the face, the adhesive and the release liner. The information 22*a* may also comprise information of the width and the length of the narrow roll, the core size of the narrow roll, winding direction, number of joins in the narrow roll etc. The information 22*a* may also comprise tracking information and any other tracing or identifier information.

The product marking 21 may also comprise one or more baby labels 22*b*. The baby labels 22*b* may comprise the same information as in the general information part 22*a* or a part of the general information. The baby labels 22 may be formed such that they can easily be detached. The baby labels 22 may be ripped off, for example. The baby labels 22 may be surface attachable labels.

The general information 22*a* may also be called internal information because the general information 22*a* may be used during sorting and handling of the narrow rolls in the flow-through warehouse 14.

The product marking 21 may also comprise customer related information 22*c*. The customer related information 22*c* may comprise customer related data such as customer trademark, customer reference or any other customer specified information. After the first information adding unit 16 the product marking 21 comprises customer related information 22*c* only if the narrow roll already has a defined customer stack when it comes from the slitting machine 1. If however the narrow roll is transferred to the rack to be stored and used in a customer stack later, the product marking 21 naturally cannot comprise customer related information 22*c*. In such case the part reserved for the customer related information 22*c* can be left empty or the part can be used for internal information, for example. The information on the product marking 21 may be presented by using text or bar codes or RFID tags or any other suitable medium. Bar codes may be linear codes or 2D codes or matrix codes or QR codes etc. The product marking 21 may also comprise any combination of the above mentioned media.

The product marking 21 may be formed on the narrow roll by printing it onto the narrow roll by using an inkjet printer, for example. It is also possible to form the product marking 21 from a tag such that the information is provided on the tag and the tag is attached to the surface of the narrow roll 2. The tag may be a paper or a film that is glued, for example, to the narrow roll 2. The tag may also be a surface attachable label that is attached to the surface of the narrow roll 2. In such case the first information adding unit 16 may be called a labelling unit. In one embodiment the attachment of the label is performed such that there is adhesive or glue between the label and the narrow roll such that the adhesive or glue covers most of the surface area between the label and the narrow roll.

The product marking 21 may also be an invisible marking. An example of an invisible marking is a RFID tag that is positioned inside the narrow roll such that it cannot be seen outside of the narrow roll 2. In such case the invisible marking can be positioned inside the core of the narrow roll or embedded inside the structure of the core of the narrow roll. The RFID tag may also be positioned in connection with a visible tag, for example. Thus, the RFID tag may be in connection with a surface attachable label or in connection with a baby label.

Examples of the visible product marking 21 are the printed product marking and the tag that is attached to the narrow roll 2.

In the second information adding unit 17 the product markings 21 that do not have customer related information 22*c* are provided with the customer related information 22*c*. It is also possible that the customer related information 22*c* is not correct anymore. In such case the product marking 21 is provided with an updated customer related information 22*c*.

The second information adding unit 17 may add the information by printing, for example. Thus, the second information adding unit 17 may by an inkjet printer, for example.

Figure 6:
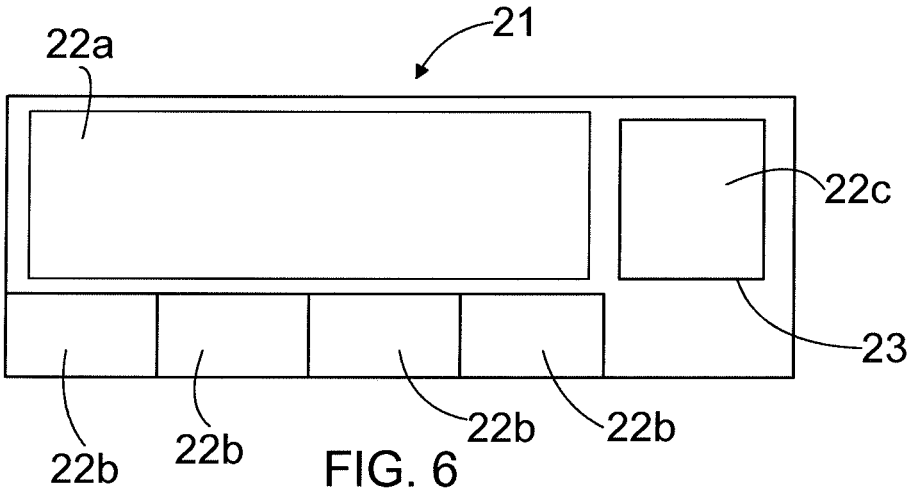

In one embodiment the customer related information 22*c* is provided on a tag, such as a paper or a film that is glued, for example, on the product marking 21 on the surface of the narrow roll 2. The tag may also be a customer label 23 which is a surface attachable label and the customer label 23 is attached on the product marking 21 on the surface of the narrow roll 2. This embodiment is shown in FIG. 6. In such case also the second informal adding unit 17 may be called a labelling unit.

The customer label 23 may be smaller than the area of the product marking 21, whereby in the second information adding unit 17 labels smaller than the total product marking area may be used. Thus general information 22*a* or baby labels 22*b* need not be provided on the narrow roll in the second information adding unit 17.

If the product marking 21 is invisible, naturally the second information adding unit 17 uses technology similar to the first information adding unit 16 when adding the customer related information 22*c* to the product marking 21.

In one embodiment the first information adding unit 16 is positioned before the first rack row 6*a* and the second information adding unit 17 is positioned after the first rack row 6*a*. In another embodiment the second information adding unit 17 is positioned after the second rack row of the warehouse and in a third embodiment the second information adding unit 17 is positioned after the last rack row of the warehouse.

The narrow roll may be provided with the customer related information 22*c* by the first information adding unit 16 if the narrow roll has a defined customer stack when it comes from the slitting machine.

In an embodiment at least 10% of the narrow rolls are provided with customer related information 22*c* by the first information adding unit 16. In another embodiment at least 50% of the narrow rolls are provided with customer related information 22*c* by the first information adding unit 16. In a further embodiment 40-95% and in another embodiment 70-90% of the narrow rolls are provided with customer related information 22*c* by the first information adding unit 16. In a further embodiment at least 10% of the narrow rolls are provided with the customer related information 22*c* by the second information adding unit 17. In a further embodiment at least 50% of the narrow rolls are provided with the customer related information 22*c* by the second information adding unit. In a further embodiment 100% of the narrow rolls are provided with customer related information 22*c* by the second information adding unit 17.

A customer stack may comprise narrow rolls directly from the slitting machines or narrow rolls that come from the storage racks of the warehouse where they have been stored for a while after a slitting process or any combination of the above. Thus, in an embodiment a customer stack comprises narrow rolls such that at least 50% of the narrow rolls are provided with customer related information 22*c* by the first information adding unit 16. In a further embodiment the customer stack comprises narrow rolls such that 40-95% of the narrow rolls are provided with customer related information 22*c* by the first information adding unit 16. In a further embodiment a customer stack comprises narrow rolls such that at least 10% of the narrow rolls are provided with the customer related information 22*c* by the second information adding unit 17.

In an embodiment in the first information adding step a product marking comprising general information is provided and in the second information adding step the same product marking is complemented by adding customer information. The complemented product marking thus comprises general information and the customer information. In one embodiment the first information adding unit provides the product marking on the narrow roll the product marking comprising general information and the second information adding unit provides the customer information to the same product marking. Thus the product marking is provided by two separate information adding units such that the both units add information to the same product marking. In one embodiment the product marking comprises a common area such that both the first information adding unit and the second information adding unit add information to the common area of the product marking. If the product marking is a visible marking whereby the common area may be formed by the surface area of the product marking, for example. If the product marking is an invisible marking the common area may be formed by data storage such as computer memory, for example.

In the flow-through warehouse 14, at least after the first information adding unit 16, the narrow rolls 2 are handled without rotating the narrow rolls 2. Thus, the narrow rolls are handled without moving the narrow rolls around the axis of the narrow roll. In one embodiment, rotating is avoided or handling is performed without rotating if the movement around the axis is less than 5°, in another embodiment less than 3° and in a further embodiment less than 1°. Thereby the product marking 1 remains on a correct position. Thus, for example, if the product marking is positioned on top of the narrow roll it remains on top of the narrow roll. Thereby, for example, it is easy to adjust the second information adding unit 17 to position the customer related information 22*c* into a correct position in the product marking 21. Furthermore, the product marking of a narrow roll is circumferentially aligned with the product marking of another narrow roll. For example, in a customer stack the product marking 21 of one narrow roll is circumferentially aligned with the product marking of another narrow roll. Circumferentially aligned means that in the circumferential direction the product marking of one narrow roll is at least partly in the same position as the product marking of another narrow roll. When in the customer stack the product markings are circumferentially aligned it is possible to position the customer stacks on the pallet such that all the product markings are circumferentially aligned and visible on the outside of the pallet.

It will be obvious to a person skilled in the art that, as the technology advances, the inventive concept can be implemented in various ways. The invention and its embodiments are not limited to the examples described above but may vary within the scope of the claims. The arrangement may also be formed such that in addition to narrow rolls also jumbo reels are transferred through the flow-through warehouse. The jumbo reels may also be transferred in the axial direction.

The invention claimed is:

1. A method for handling narrow rolls, comprising the steps of:

providing the narrow rolls with a product marking in a first information adding step by using first information adding units positioned before a rack row of a flow-through warehouse, the product marking comprising at least general information; and in a second information adding step, complementing said product marking in at least some of the narrow rolls with customer information by using a second information adding unit positioned after the rack row of the flow-through warehouse, the customer information being provided adjacent to the at least general information, whereby after the second information adding step all the narrow rolls have the product marking comprising both the at least general information and the customer information which are both visible at the same time.

2. The method as claimed in claim 1, wherein the product marking is a visible product marking.

3. The method as claimed in claim 2, wherein at least the customer information is provided on a tag attached to a surface of the narrow roll.

4. The method as claimed in claim 2, wherein the product marking is provided on a tag attached to a surface of the narrow roll.

5. The method as claimed in claim 1, wherein in the first information adding step, the information is provided on a tag attached to a surface of the narrow roll, and in the second information adding step another tag is provided with customer information, and the second tag is attached to the first tag.

6. The method as claimed in claim 2, wherein the product marking is provided on a tag that is a surface attachable label.

7. The method as claimed in claim 1, wherein the product marking comprises at least one baby label.

8. The method as claimed in claim 1, wherein in the second information adding step, the same product marking that was provided with general information in the first information adding step is complemented by adding customer information.

9. An arrangement for handling narrow rolls, the arrangement comprising:

a first information adding unit configured to provide a product marking on a narrow roll, the product marking comprising at least general information, wherein the first information adding units is positioned before a rack row of a flow-through warehouse; and a second information adding unit configured to complement said product marking in at least some of the narrow rolls with customer information, the customer information being provided adjacent to the at least general information, wherein the second information adding unit is positioned after the rack row of the flow-through warehouse, such that after the second information adding unit all the narrow rolls have a product marking comprising both the at least general information and the customer information which are both visible at the same time.

10. The arrangement as claimed in claim 9, wherein the second information adding unit is arranged to provide the customer information to the same product marking that was provided with general information by the first information adding unit.

* * * * *